United States Patent [19]

Menown

[11] 4,356,426

[45] Oct. 26, 1982

[54] THYRATRON HAVING ANODE WITH LOW WORK FUNCTION MATERIAL

[75] Inventor: Hugh Menown, Writtle, England

[73] Assignee: English Electric Valve Company Limited, Chelmsford, England

[21] Appl. No.: 149,646

[22] Filed: May 14, 1980

[30] Foreign Application Priority Data

May 15, 1979 [GB] United Kingdom ..... 7916814

[51] Int. Cl.[3] ..... H01J 17/10

[52] U.S. Cl. ..... 313/193; 313/211; 313/218

[58] Field of Search ..... 313/218, 211, 197, 193

[56] References Cited

U.S. PATENT DOCUMENTS

| | | | |
|---|---|---|---|
| 3,110,834 | 11/1963 | Schneider et al. | 313/193 X |
| 3,244,925 | 4/1966 | Baker et al. | 313/213 X |
| 3,479,549 | 11/1969 | Baker | 313/193 X |
| 3,898,518 | 8/1975 | Menown et al. | 313/197 X |
| 4,097,762 | 6/1978 | Hilton et al. | 313/218 |

FOREIGN PATENT DOCUMENTS

| | | |
|---|---|---|
| 411355 | 7/1934 | United Kingdom . |
| 505529 | 5/1939 | United Kingdom . |
| 669640 | 4/1952 | United Kingdom . |
| 835400 | 5/1960 | United Kingdom . |
| 983159 | 2/1965 | United Kingdom . |
| 1100325 | 1/1968 | United Kingdom . |

*Primary Examiner*—Palmer C. Demeo
*Attorney, Agent, or Firm*—Spencer & Kaye

[57] ABSTRACT

The invention concerns thyratrons and in particular thyratrons which are required to be able to conduct protectively in a reverse direction. In order to assist in such reverse conduction an electrode which at such times acts as a cathode e.g. a conventional anode is formed or includes material of low work function such as tungsten impregnated with barium aluminate. Where the electrode in question is a plate anode the disc or plate is itself formed of the low work function material. Where the anode is a so-called hollow anode material of low work function may be introduced within the interior of the hollow anode. Where the anode electrode is in the well known form of an inverted cup material of low work function may be provided as a layer on the surface thereof facing the cathode.

4 Claims, 3 Drawing Figures

THYRATRON HAVING ANODE WITH LOW WORK FUNCTION MATERIAL

BACKGROUND OF THE INVENTION

This invention relates to thyratrons.

Thyratrons are often required to "arc back" or conduct in a reverse direction following a forward pulse. In a conventional uni-direction thyratron reverse arcing results in damage to the tube with a resulting shortening of life. In order to reduce this difficulty double cathode thyratrons may be employed or special thyratrons having a conventional cathode arrangement at one end and a hollow anode at the other end which hollow anode acts to trap plasma which enables conduction to occur in a reverse direction albeit of limited energy.

The double cathode thyratron suffers from the disadvantage that cathode heating is required to be employed at what would normally be regarded as the anode end i.e. the high voltage end. This involves the use of relatively expensive low capacity stand off transformers. Ancilliary supplies to drive the grids at the high voltage end are also necessary.

The present invention seeks to provide an improved thyratron in which the ability to conduct in a reverse direction is enhanced.

SUMMARY OF THE INVENTION

According to this invention in its broadest aspect a thyratron is provided wherein in operation a plasma exists which acts as a carrier for current flowing during discharge and wherein an electrode arrangement provided to act as a cathode includes material of a low work function acting as a source of electrons by ion bombardment.

Preferably said material of low work function is tungsten impregnated with barium aluminate.

Said thyratron may be such that said electrode arrangement acts at times as a cathode and at other times as an anode, e.g. a so-called double cathode thyratron.

In one example of a thyratron in accordance with the present invention said thyratron consists of a conventional cathode at one end and an anode at the other end which anode contains or is formed of said material of low work function.

Said anode may take the form of a plate formed at least in part of said material of low work function or said anode may be provided as a hollow anode formed at least in part of said material of low work function or containing said material of low work function.

DETAILED DESCRIPTION OF THE PREFERRED EMBODIMENTS

In the figures like references are used for like parts.

Figure 1:
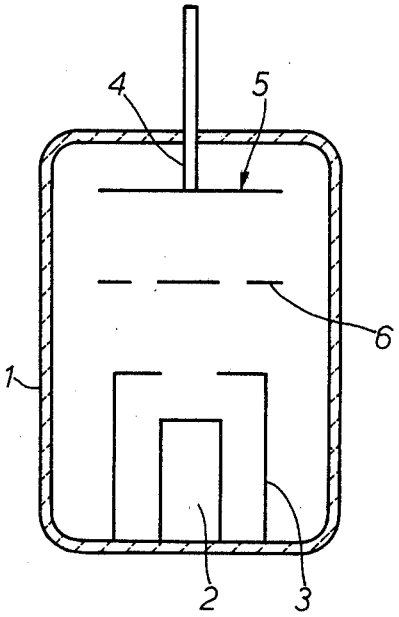
FIG. 1 illustrates in schematic manner a first embodiment of the thyratron according to the invention.

Referring to FIG. 1, the thyratron consists of a ceramic envelope 1 within which at one end there is provided a cathode 2 surrounded by a shield 3 and at the other end an anode electrode 4. In this case the anode electrode is a plate anode comprising a disc 5. Between the anode disc 5 and the cathode shield 3 is interposed a control grid 6 to which in operation trigger pulses may be applied.

As so far described the thyratron is wholly conventional albeit of a very simple type for ease of illustration.

In accordance with the present invention the anode disc 5 is made of a low work function material in this case tungsten impregnated with barium aluminate.

In operation ion bombardment of the barium aluminate impregnated tungsten anode disc 5 due to the plasma existing within the tube during discharge acts as a source of electrons during reverse conduction when the anode disc 5 is acting as a cathode.

Figure 2:
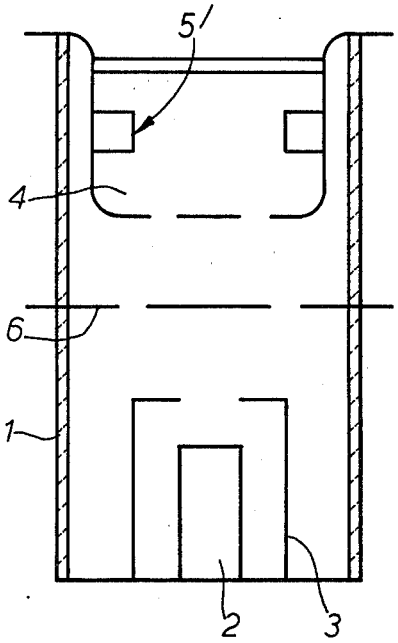
FIG. 2 is a schematic drawing of a second embodiment of the invention.

Referring to FIG. 2 in this case the anode electrode 4 is a so-called hollow anode within which plasma tends to be trapped as described in our co-pending application, Ser. No. 9306/78.

In this case a mass of low work function material here referenced 5' and again consisting of tungsten impregnated with barium aluminate is provided within the hollow anode body. The low work function material 5' may be discrete particles but in this instance the material is provided as a complete annulus within the hollow anode.

Figure 3:
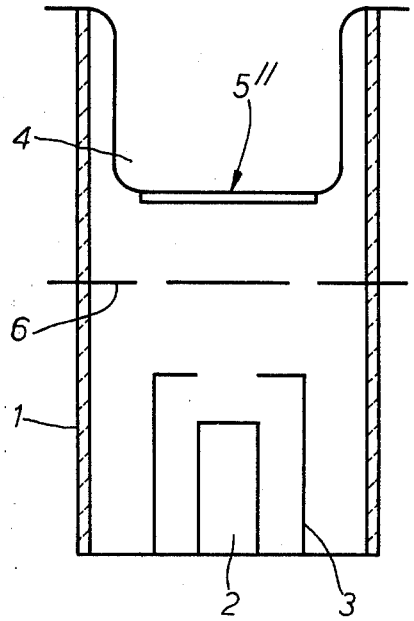
FIG. 3 shows schematicly a third embodiment of the invention.

Referring to FIG. 3, the anode electrode is conventionally provided in the form of an inverted cup the "interior" of which is sealed against plasma. In this case low work function material 5'' again of tungsten impregnated with barium aluminate is provided in the form of a layer on the surface of the anode facing the control grid 6 and the cathode 2.

I claim:

1. In a thyratron including a sealed envelope; an electrode assembly positioned within said sealed envelope including a cathode located at one end thereof, an anode at the other end and a control grid interposed between said cathode and said anode; means for applying a positive voltage to said anode with respect to said cathode; and a gas contained within said envelope, said gas forming a plasma in response to the application of a voltage to said electrode assembly and acting as a carrier for current flowing between said anode and said cathode; the improvement wherein said anode comprises a material having a low work function whereby upon reversal of the polarity of the voltage between said anode and cathode, during operation of said thyratron, said anode is bombarded by ions and said low work function material emits electrons thereby enhancing reverse current flow.

2. A thyratron as claimed in claim 1 wherein said anode comprises a plate.

3. A thyratron as claimed in claim 1 wherein said anode comprises a hollow construction.

4. A thyratron as claimed in claims 2 or 3 wherein said material of low work function is tungsten impregnated by barium aluminate.

* * * * *